United States Patent [19]

Shimizu

[11] Patent Number: 5,003,221

[45] Date of Patent: Mar. 26, 1991

[54] ELECTROLUMINESCENCE ELEMENT

[75] Inventor: Yasumoto Shimizu, Tokyo, Japan

[73] Assignee: Hoya Corporation, Tokyo, Japan

[21] Appl. No.: 237,528

[22] Filed: Aug. 26, 1988

[30] Foreign Application Priority Data

Aug. 29, 1987 [JP] Japan ..... 61-215854
Oct. 31, 1987 [JP] Japan ..... 61-277025

[51] Int. Cl.[5] ..... H05B 33/02; H05B 33/22

[52] U.S. Cl. ..... 313/509; 313/114; 313/512; 427/66

[58] Field of Search ..... 313/114, 506, 509, 512; 427/66; 428/690, 917

[56] References Cited

U.S. PATENT DOCUMENTS 3,854,070 12/1974 Vlasenko et al. ..... 313/509 X
4,590,128 5/1986 Kawai ..... 313/509 X
4,670,355 6/1987 Matsudaira ..... 313/509 X

FOREIGN PATENT DOCUMENTS 225795 7/1986 Japan .

*Primary Examiner*—Sandra L. O'Shea
*Attorney, Agent, or Firm*—Blakely, Sokoloff, Taylor & Zafman

[57] ABSTRACT

In an EL element of this invention, a thin film layer is formed between a transparent substrate and a layer formed adjacent to the transparent substrate, and the refractive index of the thin film layer is changed to be approximated to those of these layers toward the interfaces between the thin film layer and the corresponding layers, so that a difference in refractive index at these interfaces is minimized. The thin film layer may be formed between at least two adjacent layers formed on the transparent substrate.

9 Claims, 2 Drawing Sheets

ELECTROLUMINESCENCE ELEMENT

BACKGROUND OF THE INVENTION

The present invention relates to an electroluminescence element which is utilized as a still image or motion picture display means in a low-profile display device of a terminal of a computer system or the like.

FIG. 7 is a sectional view showing a conventional electroluminescence (to be abbreviated as an EL hereinafter) element of this type. As shown in FIG. 7, the conventional EL element is formed as follows. That is, a reflection preventive film 2 of SiO, MgO, or the like is formed on a transparent substrate 1 of a glass plate. Transparent electrode layers 3 of $In_2O_3$, $SnO_2$, or the like are aligned on the reflection preventive film 2. A first dielectric layer 4 of $Y_2O_3$, $Ta_2O_5$ or the like, an electroluminescent layer 5 of ZnS or the like in which 0.1 to 2 wt. % of Mn are doped as an activator, and a second dielectric layer 6 are sequentially stacked on the transparent electrode layer 3. Thereafter back electrode layers 7 of Al, Ta, Mo, or the like are aligned on the second dielectric layer 6. In this case, when viewed from the transparent electrode layer, a region where one transparent electrode layer and the corresponding back electrode layer crosses constitutes one pixel. When an AC voltage is applied between the electrodes, yellowish orange light having Mn as the activator is emitted from each pixel portion. Thus, display is made by controlling a voltage applied to the electrodes (e.g., refer to Japanese Patent Laid-Open No. 51-33579).

The reflection preventive film 2 in the conventional EL film adopts the principle that if the following thin film layer is interposed between two materials respectively having refractive indices of $n_1$ and $n_2$, reflectance with respect light of the wavelength $\lambda$ at the interface between the two materials becomes zero:

Refractive index: $n=(n_1 \cdot n_2)^{\frac{1}{2}}$

Film Thickness: $t=\lambda/4$ ($\lambda$: wavelength of light)

If the refractive index of the transparent substrate 1 is represented by $n_1$, the refractive index of the transparent electrode layer 3 is represented by $n_2$, and the central wavelength of light emitted from the electroluminescent layer 5 (to be referred to as EL light hereinafter) is represented by $\lambda$, the refractive index and the film thickness of the reflection preventive film 2 are selected to satisfy the above conditions. Then, the EL light from the electroluminescent layer 5 can be prevented from being reflected by the interface between the transparent substrate 1 and the transparent electrode layer 3. Thus, a decrease in effective luminance can be prevented.

The dielectric layer in the EL element is required to have high dielectric breakdown voltage and dielectric constant and small dielectric loss. In addition to these requirements, the first dielectric layer formed between the electroluminescent layer and the transparent substrate on which the transparent electrodes are formed is required to have a high adhesion force with the transparent substrate and transparent electrodes, and not to cause abnormality such as film cracking or peeling in a high-temperature heat treatment for activation after the electroluminescent layer is formed.

The conventional dielectric layer employs a single layer or multilayers of an oxide such as $Y_2O_3$, $Ta_2O_5$, $Al_2O_3$, $HfO_2$, $PbTiO_3$, $BaTa_2O_6$, or the like, or a material such as $Si_3N_4$, silicon oxynitride, or the like. The layers of these materials are normally formed by the sputtering technique in order to prevent insulating breakdown due to microdefects.

However, the conventional EL element described above has the following problems:

(1) As described above, the refractive index n of the reflection preventive film 2 must satisfy the following relation if the refractive index of the transparent substrate 1 is represented by $n_1$ and the refractive index of the transparent electrode layer 3 is represented by $n_2$:

$$n=(n_1 \cdot n_2)^{\frac{1}{2}}$$

However, the transparent substrate 1 and the transparent electrode layer 3 can only employ very limited materials. The values of $n_1$ and $n_2$ are limited in advance by the materials which can be used. As a result, the value of n must be a limited, specific value derived from the values of $n_1$ and $n_2$. However, it is not easy to form a thin film having such a specific refractive index.

(2) In order to effectively apply a voltage applied between the transparent electrode layer 3 and the back electrode layer 7 to the electroluminescent layer 5, the specific dielectric constant of the layers interposed between the electrodes and the electroluminescent layer 5 must be increased as large as possible or their film thicknesses must be decreased, so that a voltage loss caused by a voltage drop across these layers is reduced as small as possible. However, the specific dielectric constant of a material normally employed for the reflection preventive film 2 is small (e.g., the specific dielectric constants of the above-mentioned SiO and MgO are respectively 4 to 6 and 9 to 10). In addition, in order to obtain the functions of the reflection preventive film, the reflection preventive film must have a thickness $\frac{1}{4}$ the central wavelength $\lambda$ (in this case, about 1,500 Å) of the EL light from the electroluminescent layer 5. For this reason, a voltage loss due to a voltage drop is considerably increased.

(3) The reflection preventive film 2 can provide a reflection preventive effect with respect to only light having the wavelength $\lambda$, i.e., the central wavelength of the EL light, and cannot provide the effect with respect to light of other wavelengths. Therefore, although the EL light from the electroluminescent layer 5 is efficiently output outside the layer, almost no reflection preventive effect can be obtained with respect to white light including various wavelengths externally incident on the EL element. Therefore, when the EL element is used in a bright location, the display is not easy to see due to reflection of external light.

(4) When the dielectric layer is formed by sputtering an oxide, the underlying transparent electrode may be darkened due to the influence of oxygen plasma, or an electrical resistance may be increased. Meanwhile, most compositions constituting the above-mentioned dielectric layer do not have sufficient adhesion force with the transparent substrate and electrodes. For this reason, peeling tends to occur by a heat treatment at a temperature of 400° C. to 600° C. performed for activating the electroluminescent layer. In order to solve this problem, the present inventors have already proposed a technique of preventing film peeling and degradation in the transparent electrode wherein an $SiO_2$ film having good adhesion properties with the respective film layers is formed between the transparent substrate, the transparent electrodes and the dielectric layer in an argon gas atmosphere (Y. SHIMIZU, et al., CONFERENCE RECORD OF THE 1985 INTERNATIONAL DIS- PLAY RESEARCH CONFERENCE, P101, 1985). However, since the EL element with this structure has a large difference of refractive indices of the $SiO_2$ film and the dielectric layer (e.g., if a $BaTa_2O_6$ film is used as the dielectric layer, the refractive index of the dielectric layer is 2.4, while the refractive index of the $SiO_2$ film is 1.4), a reflectance at their interface is increased, resulting in unclear display.

SUMMARY OF THE INVENTION

It is, therefore, a principal object of the present invention to provide an EL element which can provide a reflection preventive effect and is easy to see.

It is another object of the present invention to provide an EL element which can efficiently emit EL light with high luminance.

According to the present invention, a thin film layer is formed between a transparent substrate and a layer formed adjacent to the transparent substrate or between at least two adjacent layers formed on the transparent substrate, and the refractive index of the thin film layer is changed to be approximated to those of these layers toward the interfaces between the thin film layer and the corresponding layers, so that a difference in refractive index at the layer interface is minimized. Thus, an EL element which can minimize reflection at interfaces between the respective layers can be obtained.

More specifically, in order to achieve the above objects, there is provided an EL element in which a plurality of layers including at least a transparent electrode layer, a back electrode layer, and at least one layer including an electroluminescent layer formed between the back electrode layer and the transparent electrode layer are formed on a transparent substrate, wherein a thin film layer is formed between the transparent substrate and the layer formed adjacent to the transparent substrate or between at least two adjacent layers of the plurality of layers formed on the transparent substrate, and a refractive index of the thin film layer is changed to be approximated to a refractive index of a corresponding one of the plurality of layers toward an interface with this corresponding layer.

In the EL element of the above structure, when a control voltage is applied between the transparent electrode layers and the back electrode layers, yellowish orange light having Mn as an activator is emitted from each pixel formed on a region where the transparent and back electrode layers cross, thus allowing display.

In this EL element, a thin film layer is formed between a transparent substrate and a layer formed adjacent to the transparent substrate and between at least two adjacent layers formed on the transparent substrate, and the refractive index of the thin film layer is changed to be approximated to those of these layers toward the interfaces between the thin film layer and the corresponding layers, so that a difference in refractive index at these interfaces is minimized. Thus, reflection at these interfaces can be suppressed. Unlike in the prior art, the reflection preventive effect is not limited to a specific wavelength $\lambda$, and hence, EL light can be efficiently emitted. In addition, the reflection preventive effect can be obtained with respect to external white light incident on the EL element, resulting in display which is easy to see. The thickness of the thin film need not be $\lambda/4$, and can be considerably decreased. Therefore, a voltage drop of the applied voltage across the thin film can be greatly reduced, and hence, EL light with high luminance can be efficiently obtained.

DESCRIPTION OF THE PREFERRED EMBODIMENTS

Preferred embodiments of the present invention will be described hereinafter with reference to the accompanying drawings.

Figure 1:
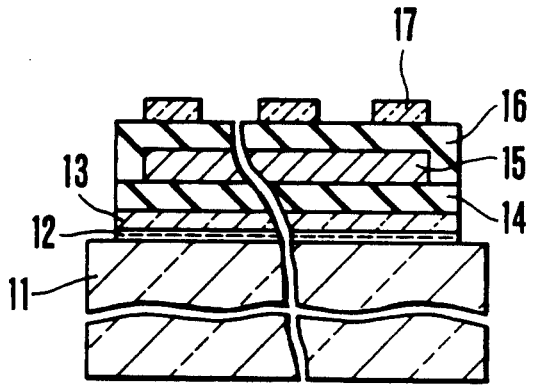
FIG. 1 is a sectional view showing a first embodiment of an EL element according to the present invention.

FIG. 1 shows an EL element according to the first embodiment of the present invention. In FIG. 1, reference numeral 11 denotes a transparent substrate (refractive index=1.5). A thin film layer 12 is formed on the transparent substrate 11, and a plurality of stripe transparent electrode layers 13 (refractive index=1.9) are formed substantially parallel to each other at equal intervals on the thin film layer 12 (FIG. 1 illustrates the longitudinal section of one of the plurality of transparent electrode layers 13).

In this case, the thin film layer 12 is formed to have a refractive index which changes as follows. That is, the refractive index near the interface with the transparent substrate 11 is the same as that (1.5) of the transparent substrate 11, is gradually increased from a portion near this interface toward an interface with the transparent electrode layer 13 and becomes equal to that (1.9) of the transparent electrode layer near the interface with the transparent electrode layer 13.

The thin film layer 12 can be obtained such that a value x or y of a material expressed by the formula $MO_x$ or $LN_y$ *l is changed in the direction of thickness, or a mixing ratio of a mixture obtained by mixing two materials having different refractive indices is changed in the direction of thickness:* where

M . . . Metal Element selected from the group of Si, Al, Mg, Ta, Ti, Zr, Hf, Y or the like O . . . Oxygen x . . . Value $\frac{1}{2}$ or less a valence of M L . . . Metal Element selected from the group of Si, Al, Mg, Ta, Ti, Zr, Hf, Y or the like N . . . Nitrogen y . . . Value $\frac{1}{3}$ or less a valence of L More specifically, the $MO_x$ includes $SiO_2$, $Al_2O_3$, MgO, $Ta_2O_5$, $Y_2O_3$, $TiO_2$, $ZrO_2$, $HfO_2$ or the like, and $LN_y$ includes AlN, $Si_3N_4$, or the like.

A first dielectric layer 14 (refractive index=2.3) is formed on the transparent electrode layers 13, and an electroluminescent layer 15 is formed on the first dielectric layer 14. A plurality of stripe back electrode layers 17 are formed on the electroluminescent layer 15 through a second dielectric layer 16 to be perpendicular to the corresponding transparent electrode layers 13.

When an AC voltage (150 V) is applied between the transparent electrode layers 13 and the back electrode layers 17, the EL element thus formed emits yellowish orange light having a peak wavelength of about 5,800 Å from the electroluminescent layer 15. Thus, the voltage applied between these electrodes is variably controlled, thus allowing display.

With this arrangement, the refractive index of the portion of the thin film layer near the interface between the thin film layer 12 and the transparent substrate 11 and the refractive index of the transparent substrate 11 are equal to each other, i.e., 1.5, and the refractive index of the portion of the thin film layer near the interface between the thin film layer 12 and the transparent electrode layers 13 and the refractive index of the transparent electrode layers 13 are equal to each other, i.e., 1.9. Therefore, the reflection of light at these interfaces becomes substantially negligible. Unlike in the conventional EL element, the reflection preventive effect is not limited to a specific wavelength λ. Therefore, EL light can be efficiently emitted, and a reflection preventive effect can be obtained for external white light incident onto the EL element, resulting in display which is easy to see. Furthermore, the thickness of the thin film need not be λ/4, and can be considerably decreased. Thus, a voltage drop of the applied voltage across this thin film can be greatly decreased, and hence, EL light with high luminance can be efficiently obtained. According to this embodiment, the variables of the materials represented by the formula described above are properly selected or the composition is properly selected, so that the refractive index of the thin film layer 12 can be relatively easily set to satisfy the above-mentioned relation in accordance with the materials of the transparent substrate 11 and the transparent electrode layers 13. This embodiment can be relatively easily applied to various types of EL elements, resulting in an extremely wide application range.

The present inventors have tried a variety of manufacturing processes of the EL element according to this embodiment. Some manufacturing processes will be described below as manufacturing examples.

(Manufacturing Example 1-1)

Referring to FIG. 1, reactive sputtering was performed on a transparent substrate 11 (refractive index=1.5) of aluminosilicate glass (NA40 (tradename) available from HOYA CORP.) using Si as a sputter target in an argon gas atmosphere containing oxygen gas at a pressure of 0.6 Pa and at a power density of 3 W/cm$^2$ while gradually changing the partial pressure of the oxygen gas from 0.4 Pa to 0.2 Pa. As a result, an $SiO_x$ thin film layer 12 having a total film thickness of about 200 Å was formed on the glass substrate 11.

The $SiO_x$ thin film layer 12 thus formed had a value x of 1.8 near the interface with the transparent substrate 11 (in this case, the refractive index=1.5), and the value x was gradually decreased from 1.8 from the portion near the interface toward the other interface in the direction of film thickness. As a result, the value x became about 1.0 near the other interface (refractive index=1.9).

A 2,000-Å thick transparent conductive film of indium oxide mixed with tin oxide was formed on the thin film layer 12. Thereafter, the transparent conductive film was etched by a photolithography technique using a mixed solution of hydrochloric acid and ferric chloride as an etchant to form a plurality of stripe transparent electrode layers 13 (refractive index=1.9) (the right-and-left direction in FIG. 1 corresponds to the longitudinal direction of the layers 13).

Then, reactive sputtering was performed in an argon gas atmosphere containing about 30% of oxygen gas at a pressure of 0.6 Pa and at a power density of 9 W/cm$^2$ using metal tantalum as a sputter target. Thus, a 3,000-Å thick first dielectric layer 14 (refractive index=2.2) of a $Ta_2O_5$ thin film was formed on the transparent electrode layers 13.

A 6,000-Å thick electroluminescent layer 15 of a ZnS:Mn thin film was formed on the first dielectric layer 14 by a vacuum evaporation technique using a ZnS:Mn sintered pellet as an evaporation source added with about 0.5 wt. % of Mn as an activator.

Thereafter, a 3,000-Å thick second dielectric layer 16 of a $Ta_2O_5$ thin film was formed by the reactive sputtering technique following the same procedures as in the film formation of the first dielectric layer 14.

Finally, an Al thin film was formed on the second dielectric layer 16. The Al thin film was etched by the photolithography technique using a mixed solution of nitric acid and phosphoric acid as an etchant, thus forming a plurality of stripe back electrode layers 17 to be perpendicular to the transparent electrode layers 13 (in a direction perpendicular to the drawing surface of FIG. 1).

An AC voltage (150 V) was applied between the transparent electrode layers 13 and the back electrode layers 17 so that yellowish orange light having a peak wavelength of about 5,800 Å was emitted from the electroluminescent layer 15, and a voltage applied between these electrodes was variably controlled to conduct a display test. As a result, it was confirmed that the EL element thus manufactured had all the advantages described in the above embodiment.

(Manufacturing Example 1-2)

This manufacturing example is substantially the same as Manufacturing Example 1-1 described above except that the thin film layer 12 was formed of a composite thin film layer of $SiO_2$ (refractive index=1.4) and $Ta_2O_5$ (refractive index=2.2) instead of an $SiO_x$ thin film layer. Thus, this difference will be described below.

Sputtering was performed on the transparent substrate 11 using $SiO_2$ as a first sputter target and $Ta_2O_5$ as a second sputter target in an argon gas atmosphere mixed with oxygen gas at a total pressure of 0.6 Pa, an oxygen partial pressure of 0.2 Pa, and a power density of 5 W/cm$^2$ for the $SiO_2$ target and 1 W/cm$^2$ for the $Ta_2O_5$ target at the beginning of the composite thin film layer formation. As a result, a composite thin film layer having a refractive index of 1.5 was formed near an interface with the transparent substrate 11. Subsequently, the sputtering was continued under the similar conditions to those described above while gradually changing the power densities to finally 2 W/cm$^2$ for the $SiO_2$ target and 10 W/cm$^2$ for the $Ta_2O_5$ target, so that a refractive index near a portion serving as an interface with the transparent electrode layers 13 became 1.9. In this manner, the thin film layer 12 having a total film thickness of about 200 Å was obtained. In this manufacturing example, the same advantages as in Manufacturing Example 1-1 were obtained.

(Manufacturing Example 1-3)

Figure 2:
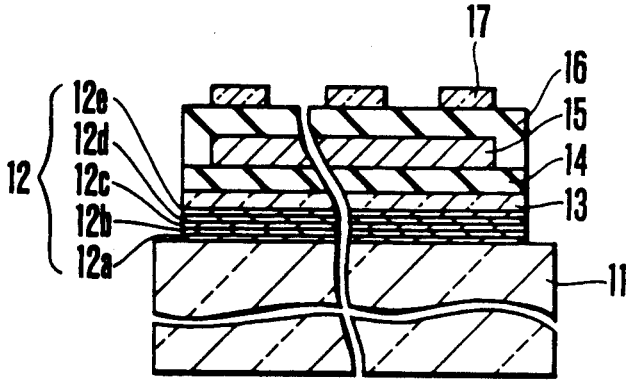
FIG. 2 is a sectional view for explaining the manufacture of the EL element according to the first embodiment of the present invention.

FIG. 2 is a view for explaining Manufacturing Example 1-3.

As shown in FIG. 2, this manufacturing example is substantially the same as Manufacturing Example 1-1 except that the $SiO_x$ thin film layer 12 in Manufacturing Example 1-1 was formed by sequentially stacking a plurality of thin films 12*a* (refractive index=1.5), 12*b* (1.6), 12*c* (1.7), 12*d* (1.8), and 12*e* (1.9) formed by varying the film formation conditions. This difference will be explained below.

In FIG. 2, sputtering was performed on the transparent substrate 11 using Si as a sputter target in an argon gas atmosphere containing oxygen gas at a total pressure of 0.6 Pa, an oxygen partial pressure of 0.2 Pa, and a power density of 3 W/cm$^2$, thus forming a 50-Å thick thin film 12*a* (refractive index=1.5). Then, sputtering was performed under substantially the same conditions as those of the thin film 12*a* except that only the oxygen partial pressure was varied, thus sequentially forming the following four thin films (each having a thickness of 50 Å). As a result, a thin film layer 12 having a total film thickness of 250 Å was formed.

More specifically, the thin film 12*b* (refractive index=1.6) was formed at an oxygen partial pressure of 0.33 Pa; 12*c* (1.7), 0.27 Pa; 12*d* (1.8), 0.23 Pa; and 12*e* (1.9), 0.20 Pa.

The same advantages as those in the above manufacturing examples were obtained by the EL element obtained in this manufacturing example.

Note that in the above manufacturing examples, since the thickness of the thin film layer 12 was very small, i.e., fell within the range of 200 to 250 Å as compared with the prior art (1,500 Å), a voltage drop of the AC control voltage applied between the electrodes across the thin film layer 12 can be minimized, and hence, a voltage can be efficiently applied to the electroluminescent layer 15. Thus, the structures of the above examples are remarkably advantageous in view of effectively obtaining EL light with high luminance.

In Manufacturing Examples 1-1 and 1-3, the partial pressure of the oxygen gas is changed while maintaining the total pressure of the oxygen and argon gases constant in order to vary the value x of the $SiO_x$ thin film layer 12 in the direction of thickness. However, the partial pressure of the oxygen gas may be changed while maintaining the partial pressure of the argon gas constant.

The sputtering technique is employed as the film formation technique of the $SiO_x$ thin film layer 12. However, various other techniques such as a vacuum evaporation technique, an ion-plating technique, and the like, allowing the above-mentioned film formation process, may be employed. In addition, materials constituting the thin film layer 12 may be those expressed by the formula $LN_x$.

Figure 3:
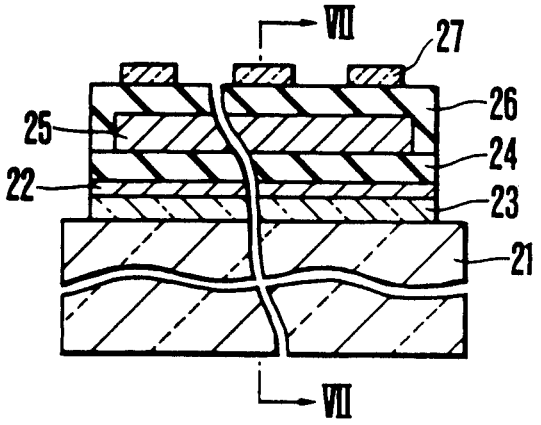
FIG. 3 is a sectional view showing a second embodiment of an EL element according to the present invention.

FIG. 3 is a sectional view showing a second embodiment of an EL element according to the present invention. Note that in this embodiment, a thin film layer is interposed between a transparent electrode and a dielectric layer.

In FIG. 3, reference numeral 21 denotes a transparent substrate (refractive index=1.5). A plurality of stripe transparent electrodes 23 (refractive index=1.7) are formed on the transparent substrate 21 to be substantially parallel to each other (FIG. 3 illustrates the longitudinal section of one of the plurality of transparent electrodes 23).

A thin film layer 22 formed of silicon (Si) and oxygen (O) expressed by the formula $SiO_x$ is formed on the transparent electrodes 23 and on portions of the transparent substrate 21 between the adjacent transparent electrodes 23.

The thin film layer 22 is formed to have the value x which changes as follows. That is, the value x in the above formula is 2 near an interface between the transparent electrodes 23 and the transparent substrate 21 (in this case, the refractive index=1.4), and is gradually decreased from 2 from the portion near this interface toward the other interface in the direction of film thickness. The value x near the other interface becomes about 0.2 (refractive index=2.2).

A first dielectric layer 24 (refractive index=2.2) is formed on the thin film layer 22, and an electroluminescent layer 25 is formed on the first dielectric layer 24. A plurality of stripe back electrodes 27 are formed on the electroluminescent layer 25 through a second dielectric layer 26 to be perpendicular to the transparent electrodes 23.

With this structure, the refractive index of the portion of the thin film layer near the interface between the thin film layer 22 and the first dielectric layer 24 is 2.2, and is equal to that of the first dielectric layer 24. In addition, the refractive index of the portion of the thin film layer near the interface between the transparent electrodes 23 and the transparent substrate 21 is 1.4, and is very close to those (1.7 and 1.5) of the transparent electrodes 23 and the transparent substrate 21.

Thus, reflectance of light at these interfaces becomes 1% or less.

The steps in the manufacture of the EL element according to this embodiment will be described below in more detail with reference to FIG. 3.

A 2,000-Å thick transparent conductive film of indium oxide mixed with tin oxide is formed by a vacuum evaporation technique on a transparent substrate 21 (refractive index=1.5) of aluminosilicate glass (e.g., NA40 (tradename) available from HOYA CORP.). Thereafter, the transparent conductive film is etched by a photolithography technique using a mixed solution of hydrochloric acid and ferric chloride as an etchant to form a plurality of stripe transparent electrodes 23 (refractive index=1.7).

Sputtering is then performed using $SiO_2$ as a sputter target in a 100%-argon gas atmosphere at a pressure of 0.6 Pa and a power density of 3 W/cm$^2$, thereby forming an $SiO_2$ thin film of several tens of angstroms on the glass substrate 21 and the transparent electrodes 23. Subsequently, reactive sputtering is performed on this $SiO_2$ thin film in an argon gas atmosphere containing an oxygen gas at a pressure of 0.6 Pa and a power density of 3 W/cm$^2$ while gradually changing the partial pressure of the oxygen gas from 0.5 Pa to 0.05 Pa. As a result, an $SiO_x$ thin film 22 having a total film thickness of 200 Å is formed on the glass substrate 21 and the transparent electrodes 23.

The $SiO_x$ thin film 22 thus formed has the value x of 2 near the interface with the transparent substrate 21 and the transparent electrodes 23, and the value x is gradually decreased from 2 from the portion near the interface toward the other interface in the direction of thickness. The value x becomes about 0.2 (refractive index=2.2) near the other interface.

Reactive sputtering is then performed using metal tantalum as a sputter target in an argon gas atmosphere containing about 30% of oxygen gas at a pressure of 0.6 Pa and a power density of 9 W/cm$^2$, thus forming a 3,000-Å thick first dielectric layer 24 (refractive index=2.2) of a $Ta_2O_5$ thin film on the $SiO_x$ thin film 22.

Then, a 6,000-Å thick electroluminescent layer 25 of a Zn:Mn thin film is formed on the first dielectric layer 24 by a vacuum evaporation technique using a ZnS:Mn sintered pellet as an evaporation source added with about 0.5 wt. % of Mn as an activator.

Thereafter, a 3,000-Å thick second dielectric layer 26 of a $Ta_2O_5$ thin film is formed by the reactive sputtering technique following the same procedures as in the film formation of the first dielectric layer 24.

Finally, an Al thin film is formed on the second dielectric layer 26, and is etched by the photolithography technique using a mixed solution of nitric acid and phosphoric acid as an etchant, thus forming a plurality of stripe back electrodes 27 to be perpendicular to the transparent electrodes 23 (in a direction perpendicular to the drawing surface in FIG. 3).

When an AC voltage (150 V) is applied between the transparent electrodes 23 and the back electrodes 27, the EL element thus manufactured emits yellowish orange light having a peak wavelength of about 5,800 Å from the electroluminescent layer 25. Thus, the voltage applied between these electrodes can be variably controlled to allow display.

In the EL element of this embodiment, although the first dielectric layer 24 is formed of an oxide, degradations such as the darkened transparent electrodes 23 or an increase in electrical resistance are not observed, and no film peeling phenomenon is observed upon annealing after film formation of the electroluminescent layer 25. Thus, it it confirmed that the presence of the $SiO_x$ thin film layer 22 is very effective to prevent degradation of the transparent electrodes 23 and film peeling of the dielectric layer 24.

At the same time, the refractive indices of the thin film layer 22 near interfaces where the thin film layer 22 contacts the transparent electrodes 23, the transparent substrate 21 and the first dielectric layer 24 are very closer to those of other layers near the interfaces, so that reflectances of light at these interfaces are as small as 1% or less.

Figure 4:
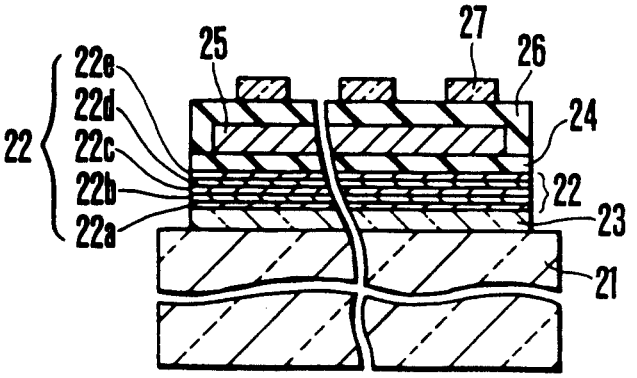
FIG. 4 is a sectional view showing a third embodiment of an EL element according to the present invention.

FIG. 4 is a sectional view showing a third embodiment of the present invention.

As shown in FIG. 4, this embodiment has substantially the same structure as that in the second embodiment, except that the $SiO_x$ thin film layer 22 in the second embodiment is formed in the third embodiment by sequentially stacking a plurality of thin films **22*a* (refractive index=1.4), 22*b* (1.6), 22*c* (1.8), 22*d* (2.0), and 22*e*** (2.2) formed by varying the film formation conditions. The difference including the corresponding manufacturing steps will be described below in detail.

Sputtering is performed using $SiO_2$ as a sputter target in a 100%-argon gas atmosphere at a pressure of 0.6 Pa and a power density of 3 W/cm$^2$, thus forming a 50-Å thick thin film **22*a* (refractive index=1.4) on the transparent substrate 21 and the transparent electrodes 23**.

Another sputtering is performed using $SiO_2$ as a sputter target in an argon gas atmosphere containing oxygen gas at a total pressure of 0.6 Pa, an oxygen partial pressure of 0.3 Pa, and a power density of 3 W/cm$^2$, thus forming a 50-Å thick thin film **22*b* (refractive index=1.6) on the thin film 22*a***.

Three more thin films (each having a thickness of 50 Å) are sequentially formed by sputtering on the thin film **22*b*** under the same film formation conditions except that only the oxygen partial pressure is varied, as follows.

More specifically, a thin film **22*c* (refractive index=1.8) is formed at an oxygen partial pressure of 0.1 Pa; 22*d* (2.0), 0.07 Pa; and 22*e*** (2.2), 0.05 Pa.

Thus, the $SiO_x$ thin film layer 22 having x which varies along the direction of thickness and having a refractive index near interfaces with other layers approximated to those of the other layers is formed.

Therefore, the same functions and effects as in the first embodiment can be obtained by the EL element according to this embodiment.

In the second and third embodiments described above, when the value x of $SiO_x$ becomes 0.5 or less, the thin film layer 22 has a light absorption property in a visible light region. Therefore, if the film thickness of the $SiO_x$ thin film layer 22 is increased too much, a decrease in luminance due to the light absorption effect of this portion cannot be ignored. Therefore, the film thickness of the $SiO_x$ thin film layer 22 is preferably 500 Å or less, so that a decrease in luminance due to the light absorption effect does not pose a problem.

The film thickness of the $SiO_x$ thin film layer 22 is preferably 500 Å or less since the voltage drop of the AC voltage applied to the electrodes across the $SiO_x$ thin film layer 22 (dielectric constant of 4 to 6) must be suppressed so that the voltage is effectively applied to the electroluminescent layer 25.

The film thickness of the $SiO_x$ thin film layer 22 is preferably 20 Å or more in order to effectively prevent degradation of the transparent electrodes 23 caused by the relationship with the first dielectric layer 24, i.e., darkening or an increase in resistance of the transparent electrode 23 or a resistance increase of the transparent electrode 23 by annealing for activating the electroluminescent layer 25 and to sufficiently enhance an effect of improving an adhesion force with the transparent electrodes 23 and the transparent substrate 21.

In the second and third embodiments, in order to vary the value x of the $SiO_x$ thin film layer 22 in the direction of thickness, the partial pressure of the oxygen gas is changed while maintaining the total pressure of the oxygen and argon gases constant during sputtering in film formation of the thin film layer 22. However, the partial pressure of the oxygen gas may be changed while maintaining the partial pressure of the argon gas constant.

The sputtering technique is employed as a film formation technique of the $SiO_x$ thin film layer 22. However, various other techniques such as a vacuum evaporation technique, ion-plating technique, and the like, allowing film formation may be employed.

Figure 5:
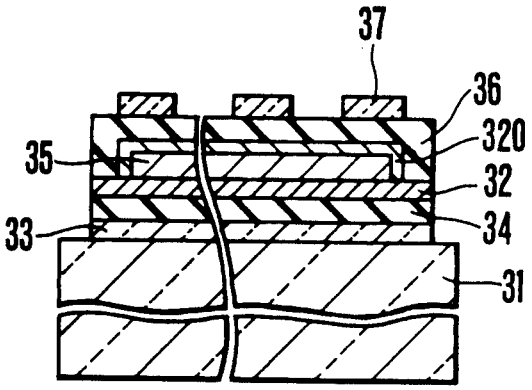
FIG. 5 is a sectional view showing a fourth embodiment of an EL element according to the present invention.

FIG. 5 is a sectional view showing a fourth embodiment of an EL element according to the present invention.

Referring to FIG. 5, reference numeral 31 denotes a transparent substrate. A plurality of stripe transparent electrode layers 33 (refractive index=1.9) are formed on the transparent substrate 31 to be substantially parallel to each other (FIG. 5 illustrates the longitudinal section of one of the plurality of transparent electrode layers 33).

A first dielectric layer 34 (refractive index=1.9) is formed on the transparent substrate 31 and the transparent electrode layers 33. A first thin film layer 32 is formed on the first dielectric layer 34. An electroluminescent layer 35 (refractive index=2.3) is formed on the first thin film layer 32. A second thin film layer 320 is formed on the electroluminescent layer 35. A plurality of stripe back electrode layers 37 are formed on the second thin film layer 320 through a second dielectric layer 36 (refractive index=1.9) to be perpendicular to the transparent electrode layers 33.

In this case, the thin film layer 32 is formed to have a refractive index which changes as follows. That is, the refractive index near the interface with the first dielectric layer 34 is the same as that (1.9) of the first dielectric layer 34, is gradually increased from the portion near this interface toward an interface with the electroluminescent layer 35 in a direction of film thickness, and becomes equal to that (2.3) of the electroluminescent layer 35 near the interface with the electroluminescent layer. The thin film layer 320 is formed to have a refractive index which changes as follows. That is, the refractive index near the interface with the electroluminescent layer 35 is the same as that (2.3) of the electroluminescent layer 35, is gradually decreased from the portion near this interface toward an interface with the second dielectric layer 36 in a direction of thickness, and becomes equal to that (1.9) of the second dielectric layer 36 near the interface with the second dielectric layer 36.

The thin film layers 32 and 320 can be obtained by changing a value x or y of materials expressed by the formula $MO_x$ or $LN_y$ in the direction of thickness or by changing the mixing ratio of the composition formed by mixing the two kinds of materials having different refractive indices in the direction of thickness in the same manner as has been described in detail in the first embodiment.

With this structure, the refractive index near the interface between the first thin film layer 32 and the first dielectric layer 34 and the refractive index of the portion of the first thin film layer 32 of the first dielectric layer 34 are equal to each other (1.9), and the refractive index near the interface between the first thin film layer 32 and the electroluminescent layer 35 and the refractive index of the portion of the first thin film layer 32 are equal to each other (2.3).

The refractive index of the portion of the second thin film layer 320 near the interface between the second thin film layer 320 and the electroluminescent layer 35 and the refractive index of the electroluminescent layer 35 are equal to each other (2.3), and the refractive index near the interface between the second thin film layer 320 and the second dielectric layer 36 and the refractive index of the second dielectric layer 36 are equal to each other (1.9).

Therefore, the reflectance of light at these interfaces is substantially negligible. Like in the first embodiment, the reflection preventive effect is not limited to a specific wavelength 80 unlike in the prior art. Therefore, EL light can be efficiently emitted, and the reflection preventive effect can be obtained with respect to external white light incident on the EL element, resulting in display which is easy to see.

The fourth embodiment will be explained below by way of its manufacturing examples.

(Manufacturing Example 4-1)

Referring to FIG. 5, a plurality of 2,000-Å thick stripe transparent electrode layers 33 (refractive index=1.9) were formed on a transparent substrate 31 of an aluminosilicate glass (e.g., NA40 (tradename) available from HOYA CORP.) following the same procedures as in Manufacturing Example 1-1 (the right-to-left direction corresponds to the longitudinal direction).

Sputtering then performed using yttrium oxide as a sputter target in an argon gas atmosphere containing about 30% of oxygen gas at a pressure of 0.3 Pa and a power density of 4 $W/cm^2$. Thus, a 3,000-Å thick first dielectric layer 34 (refractive index=1.9) of a $Y_2O_3$ thin film was formed on the transparent substrate 31 and the transparent electrode layers 33.

Reactive sputtering was performed using Si as a sputter target in an argon gas atmosphere containing oxygen gas at a pressure of 0.6 Pa and a power density of 3 $W/cm^2$ while gradually changing the partial pressure of the oxygen gas from 0.08 Pa to 0.04 Pa. As a result, an $SiO_x$ thin film layer 32 having a total thickness of about 200 Å was formed on the first dielectric layer 34.

The $SiO_x$ thin film layer 32 thus formed had a value x of 1.0 near the interface with the first dielectric layer 34 (in this case, refractive index=1.9). The value x was gradually decreased from 1.0 from the portion near this interface toward the other interface in the direction of film thickness, and became about 0.5 (refractive index=2.3) near the other interface.

A 6,000-Å thick electroluminescent layer 35 of a ZnS:Mn thin film was formed on the thin film layer 32 under the same conditions in Manufacturing Example 1-1.

A second thin film layer 320 was formed on the electroluminescent layer 35 under substantially the same conditions as in formation of the first thin film layer 32 while reversing the partial pressure changing condition of the oxygen gas (i.e., changing from 0.04 Pa to 0.08 Pa).

Thereafter, a 3,000-Å thick second dielectric layer 36 of a $Y_2O_3$ thin film was formed by the reactive sputtering technique following same procedures as in formation of the first dielectric layer 34.

Finally, a plurality of stripe back electrode layers 37 of Al thin films were formed on the second dielectric layer 36 to be perpendicular to the transparent electrode layers 33 (in a direction perpendicular to the drawing surface of FIG. 5).

After the display test, it was confirmed that the EL element thus manufactured had all the advantages described in the above embodiments.

(Manufacturing Example 4-2)

This manufacturing example is substantially the same as Manufacturing Example 4-1, except that the first and second thin film layers 32 and 320 are formed of a composite thin film layer of $SiO_2$ (refractive index=1.4) and $Ta_2O_5$ (refractive index=2.3) as two materials having different refractive indices in place of the $SiO_x$ thin film layer. The difference will be explained below.

Sputtering was simultaneously performed using $SiO_2$ as a first sputter target and $Ta_2O_5$ as a second sputter target in an argon gas atmosphere containing oxygen gas at a total pressure of 0.6 pa, an oxygen partial pressure of 0.2 Pa, and a power density of 2 $W/cm^2$ for the $SiO_2$ target and of 10 $W/cm^2$ for the $Ta_2O_5$ target at the beginning of formation of the composite thin film layer, thereby forming a composite thin film layer having a refractive index of 1.9 on a portion near the interface with the first dielectric layer 34. Subsequently, sputtering was conducted under substantially the same conditions as described above while gradually changing the power density for the $SiO_2$ target, i.e., finally at 0 W/cm$^2$ for the $SiO_2$ target and at 10 W/cm$^2$ for the $Ta_2O_5$ target, so that the refractive index near a portion to be an interface with the electroluminescent layer 35 became 2.3. In this manner, a first thin film layer 32 having a total film thickness of about 200 Å was obtained. A second thin film layer 320 having a refractive index distribution opposite to that of the first thin film layer 32 in the direction of thickness was formed on the electroluminescent layer 35 by reversing the film formation conditions for the first thin film layer 32.

In this manufacturing example, the same advantages as in Manufacturing Example 4-1 were obtained.

(Manufacturing Example 4-3)

Figure 6:
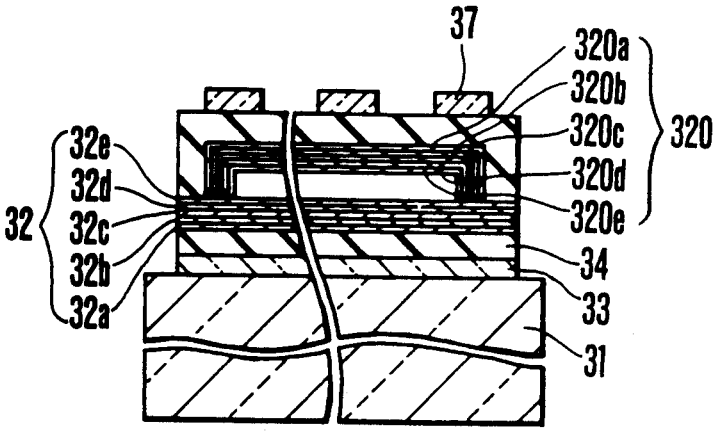
FIG. 6 is a sectional view for explaining the manufacture of the EL element according to the fourth embodiment of the present invention.
Figure 7:
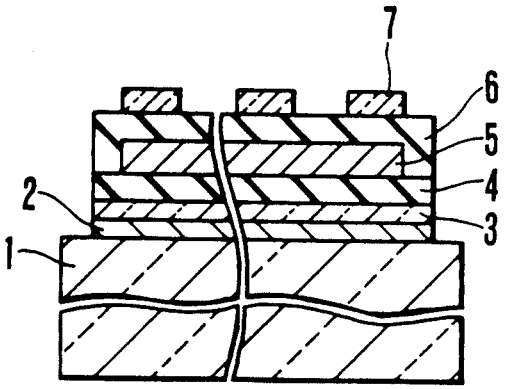
FIG.7 PRIOR ART
FIG. 7 is a sectional view showing a conventional EL element.

FIG. 6 is a sectional view for explaining Manufacturing Example 4-3.

As shown in FIG. 6, this manufacturing example is substantially the same as Manufacturing Example 4-1, except that a plurality of thin films 32*a* (refractive index=1.9), 32*b* (2.0), 32*c* (2.1), 32*d* (2.2), and 32*e* (2.3), and 320*a* (refractive index=1.9), 320*b* (2.0), 320*c* (2.1), 320*d* (2.2), and 320*e* (2.3) formed by varying the film formation conditions are sequentially stacked so as to form $SiO_x$ thin film layers 32 and 320 in Manufacturing Example 4-1. The difference will be explained below.

In FIG. 6, sputtering was performed on the first dielectric layer 34 using Si as a sputter target in an argon gas atmosphere containing oxygen gas at a total pressure of 0.6 Pa, an oxygen partial pressure of 0.2 Pa, and a power density of 3 W/cm$^2$, thereby forming a 50-Å thick thin film 32*a* (refractive index=1.9). Sputtering was sequentially performed on the thin film 32*a* under substantially the same film formation conditions as above except that the oxygen partial pressure condition was varied, thus forming four thin film layers (each having a thickness of 50 Å), as follows. As a result, a first thin film layer 32 having a total film thickness of 250 Å was formed.

More specifically, the thin film 32*b* (refractive index=2.0) was formed at an oxygen partial pressure of 0.07 Pa; 32*c* (2.1), 0.06 Pa; 32*d* (2.2), 0.05 Pa; and 32*e* (2.3), 0.04 Pa.

The thin film 320*e* (refractive index=2.3), 320*d* (2.2), 320*c* (2.1), 320*b* (2.0), and 320*a* (1.9), each having a thickness of 50 Å, were formed on the electroluminescent layer 35 in an order opposite to that described above, thereby forming a second thin film layer 320.

The EL element obtained by this manufacturing example can provide the same advantages as in the above manufacturing examples.

In each of the embodiments described above, the thin film layer having a refractive index distribution in the direction of thickness is provided between the transparent substrate and the transparent electrode layers (the first embodiment, see FIGS. 1 and 2), between the transparent electrodes and the first dielectric layer (the second and third embodiments, see FIGS. 3 and 4), or between the dielectric layer and the electroluminescent layer (the fourth embodiment, see FIGS. 5 and 6). However, the present invention is not limited to this, and includes a case wherein thin film layers are simultaneously provided between two or more layers.

More specifically, when a difference in refractive index of adjacent two layers is large at each interface, e.g., when the respective layers are formed as follows:

| | |
|---|---|
| Transparent substrate . . . glass | refractive index = 1.5 |
| Transparent electrode . . . ITO | refractive index = 1.9 |
| lst dielectric layer . . . $Al_2O_3$ | refractive index = 1.6 |
| Electroluminescent layer . . . ZnS:Mn | refractive index = 2.3 |
| 2nd dielectric layer . . . $Al_2O_3$ | refractive index = 1.6 |

it is very effective to interpose thin film layers between all the adjacent layers (that is, between the transparent electrodes and the transparent substrate, between the transparent electrodes and the first dielectric layer, between the first dielectric layer and the electroluminescent layer, and between the electroluminescent layer and the second dielectric layer).

Note that in the first embodiment, since the refractive indices of the first dielectric layer ($Ta_2O_5$) and the electroluminescent layer 15 (ZnS:Mn) are equal to each other (about 2.3), a thin film layer need not be formed at an interface between these layers.

Similarly, in the fourth embodiment, since the refractive indices of the transparent electrode layers 33 and the first dielectric layer 34 ($Y_2O_3$) are equal to each other (about 1.9), a thin film layer need not be formed at an interface between these layers.

In each of the above embodiments, the dielectric layers (first and second dielectric layers) have a single-layered structure. However, in some cases, the dielectric layers may have a multilayered structure. In this case, when a difference in refractive index of the stacked layers is large, a thin film layer is formed between these layers, thus obtaining a reflection preventive effect. More specifically, for example, when the first dielectric layer is formed by stacking two layers, i.e., an $SiO_2$ layer (refractive index=1.4) and a $Ta_2O_5$ layer (refractive index=2.3), while the second dielectric layer is formed by stacking two layers, i.e., an $Al_2O_3$ layer (refractive index=1.6) and a $Ta_2O_5$ layer (refractive index=2.3), a thin film layer is formed between the layers constituting each dielectric layer (first or second dielectric layer), thus obtaining a reflection preventive effect.

In each of the above embodiments, the electroluminescent layer has a single-layered structure, but may have a multilayered structure. In this case, when a difference in refractive index of the stacked layers is large, a thin film layer is formed between these layers, thus obtaining a reflection preventive effect. More specifically, for example, when the electroluminescent layer is formed by stacking two layers, i.e., a ZnS:Mn layer (refractive index=2.3) and a ZnSe:Mn layer (refractive index=2.6), a thin film layer is interposed between the layers constituting the electroluminescent layer, thus obtaining a reflection preventive effect.

In addition, an additional layer may be interposed between adjacent layers described in the above embodiments. More specifically, for example, a light absorption layer may be formed between the electroluminescent layer and the back electrodes in order to improve contrast. The present invention also includes a case wherein the thin film layer is interposed between layers including the additional layer.

For other thin films constituting the EL element, their materials, film thicknesses, film formation techniques and the like are not limited to the above-mentioned embodiments, and other materials, and the like allowing the same functions may be employed. More specifically, for example, the transparent substrate may be formed of a multi-component glass such as soda lime glass or quartz glass. The transparent electrode layer may be formed of $In_2O_3$, $In_2O_3$ added with W or $SnO_2$ added with Sb, F, or the like.

The dielectric layer may be formed of an oxide such as $Al_2O_3$, $SrTiO_3$, $BaTa_2O_6$, $Y_2O_3$, $HfO_2$, or the like, $Si_3N_4$, silicon oxynitride, or a composite material thereof. The electroluminescent layer may be formed of ZnSe, CaS, or SrS as a matrix material, and a rare-earth element such as Eu, Sm, Tb, Tm, or the like as a dopant. The film formation technique of this electroluminescent layer may be a sputtering technique or an MOCVD technique in place of the vacuum evaporation technique.

The back electrode layers may be formed of a metal such as Ta, Mi, NiAl, NiCr, or the like, and may be formed of the same material as that of the transparent electrode layers.

As a means for forming a plurality of stripe transparent and back electrode layers at equal intervals, a dry etching technique using a gas such as $CCL_4$ as a major component or a mask evaporation technique may be employed instead of the wet technique.

As described above, according to the present invention, a thin film layer is formed between a transparent substrate and a layer formed adjacent to the transparent substrate or between at least two adjacent layers formed on the transparent substrate, and the refractive index of the thin film layer is changed to be approximated to those of these layers toward the interfaces between the thin film layer and the corresponding layers, so that a difference in refractive index at these interfaces is minimized. A reflection preventive effect at each interface be obtained within a total wavelength range by a very thin film which can minimize a voltage drop of the applied voltage. As a result, an EL element which can efficiently emit EL light with high luminance, can minimize reflection and is easy to see can be obtained.

What is claimed is:

1. An electroluminescence element in which a plurality of layers including at least a transparent electrode layer, a back electrode layer, and at least one layer including an electroluminescent layer disposed between said back electrode layer and said transparent electrode layer, wherein said transparent electrode layer is formed on a transparent substrate, so as to emit light upon the application of an electric field between said transparent electrode layer and said back electrode layer;

wherein a thin film layer for preventing electroluminescent light from being reflected on paths from said luminescent layer to said transparent substrate is disposed at an intervening portion between said transparent substrate and said electroluminscent layer and a refractive index of said thin film layer changes in a direction from the transparent substrate toward the electroluminesecent layer.

2. An electroluminescence element according to claim 1, wherein said thin film layer is formed between said transparent substrate and said transparent electrode layer formed on said transparent substrate.

3. An electroluminescence element according to claim 1, wherein said thin film layer is formed between said transparent electrode layer formed on said transparent substrate and a dielectric layer formed on said transparent electrode layer.

4. An electroluminescence element according to claim 1, wherein said thin film layer is formed such that a value x or y of materials expressed by a formula $MO_x$ or $LN_y$ is changed in a direction of thickness, so that the refractive index of said thin film layer is changed to be approximated to a refractive index of a corresponding one of other layers contacting said thin film layer toward an interface between said thin film layer and the corresponding one of said other layers:

where

M, L . . . metal element selected from the group of Si, Al, Mg, Ta, Ti, Zr, Hf, Y O . . . oxygen N . . . nitrogen

5. An electroluminescence element according to claim 1, wherein said thin film layer is formed of a material containing silicon (Si) and oxygen (0) expressed by a formula $SiO_x$, and a value x of the material is changed in a direction of thickness, so that the refractive index of said thin film layer is changed to be approximated to a refractive index of a corresponding one of other layers contacting said thin film layer toward an interface between said thin film layer and the corresponding one of said other layers

6. An electroluminescence element according to claim 1, wherein said thin film layer is formed by mixing two kinds of materials having different refractive indices, and a mixing ratio of the materials is changed in a direction of thickness, so that the refractive index of said thin film layer is changed to be approximated to a refractive index of a corresponding one of other layers contacting said thin film layer toward an interface between said thin film layer and the corresponding one of said other layers.

7. An electroluminescence element according to claim 6, wherein the two kinds of materials comprise $SiO_2$ and $Ta_2O_5$.

8. A method of manufacturing an electroluminescence element of claim 1, wherein said thin film layer is a composite film of two kinds of materials consisting of first and second materials, and said thin film layer is formed by simultaneously sputtering the two kinds of materials consisting of the first and second materials and continuously or stepwisely changing a mixing ratio of the first and second materials, so that the mixing ratio of the first and second materials in said thin film layer is continuously or stepwisely changed along a direction of thickness.

9. A method according to claim 8, wherein the two kinds of materials comprise $SiO_2$ and $Ta_2O_5$.

* * * * *